US008366590B2

(12) United States Patent
Atnafe

(10) Patent No.: US 8,366,590 B2
(45) Date of Patent: Feb. 5, 2013

(54) BACK MACHINE AND METHOD

(76) Inventor: Fikre Atnafe, Oakland, CA (US)

( * ) Notice: Subject to any disclaimer, the term of this patent is extended or adjusted under 35 U.S.C. 154(b) by 333 days.

(21) Appl. No.: 12/877,099

(22) Filed: Sep. 7, 2010

(65) Prior Publication Data

US 2012/0058869 A1 Mar. 8, 2012

(51) Int. Cl.
*A63B 26/00* (2006.01)
*A63B 23/00* (2006.01)

(52) U.S. Cl. ..... 482/52; 482/142

(58) Field of Classification Search ..... 482/140–142, 482/148, 23, 41–42, 51, 52, 907
See application file for complete search history.

(56) References Cited

U.S. PATENT DOCUMENTS 3,713,653 A * 1/1973 Romans ..... 482/146
5,118,101 A * 6/1992 Belli ..... 482/52
6,066,076 A * 5/2000 Wang et al. ..... 482/52
7,147,591 B2 * 12/2006 McAvoy ..... 482/91
7,156,788 B1 * 1/2007 Jackson et al. ..... 482/141
7,311,645 B1 * 12/2007 Lynch ..... 482/142
D578,582 S * 10/2008 Gomez ..... D21/686
7,455,634 B2 * 11/2008 Barniak ..... 482/143
7,988,163 B2 * 8/2011 Accetta ..... 280/87.05
7,998,043 B2 * 8/2011 Zhou et al. ..... 482/139
8,043,199 B1 * 10/2011 Barker ..... 482/140
2011/0172071 A1 * 7/2011 Piane, Jr. ..... 482/142

* cited by examiner

*Primary Examiner* — Stephen Crow
(74) *Attorney, Agent, or Firm* — NWAMU, P.C; Fidel D. Nwamu

(57) ABSTRACT

A back machine and method that can be employed by individuals particularly those with chronic back pain to stretch the lower back muscles, realign and strengthen the lower spine and also to reduce pain. The back machine includes a base portion and a frame portion. The frame portion includes a lower end attached to the base portion. The frame portion extends in a vertical direction from the base portion to a height that is substantially above that of an average user standing upright on said base portion. The back machine includes a handle bar portion, a right foot support elevated above the base; a right leg restraint adjacent to the right foot support; a left foot support elevated above the base; and a left leg restraint restraining movement of a user's left leg when elevated.

11 Claims, 3 Drawing Sheets

BACK MACHINE AND METHOD

BACKGROUND OF THE INVENTION

The present invention relates generally to exercise or body conditioning machines and more specifically to body conditioning machines for the human back.

The human back is a complex mechanism that includes multiple bones, muscles and tendons, all of which work cooperatively to provide motion and stability to a human being. The lower spinal area namely the thoracic, lumber and sacral regions remains a workhorse that is continuously subjected to stress and strain.

Consequently, the percentage of the U.S. population suffering from frequent discomfort and pain of the lower spinal area is estimated at 30 percent. And, the associated health care cost ranging in the billions of dollars is expected to increase.

Back pain remains a mystery. Two individuals might have herniated disks, one may experience constant back pain while the other experiences no back pain for an entire lifetime. Pain may occur from injury or unexpected stress. Subluxation or misalignment of spine vertebrae can also cause back pain. In the case of subluxation, chiropractors might utilize certain predetermined twisting positions and stretching to attempt realignment of the back.

In any event, many individuals can experience reduced back pain by constantly exercising, stretching and engaging in activities that strengthen, align and increase mobility in their backs.

BRIEF SUMMARY OF THE INVENTION

Various aspects of a back machine and method can be found in exemplary embodiments of the present invention. In a first embodiment, the back machine includes a support base resting on the ground. Attached to this support base is a substantially vertical frame rising upward toward a cross handle bar. The cross handle bar supports the raised arms of a user during use. This cross handle bar height is preferably between 4 and 8 feet, and is above an upright user standing on the support base.

Above the support base is a right foot support that can support the raised right foot of the user. A tendency might exist for the right foot to move during usage. As such, a right leg restraint is attached to the right foot support to prevent such leg movement when the right foot is elevated. Here, the right leg restraint and the right foot support are substantially perpendicular.

Corresponding to the right foot support is a left foot support that can support the raised left foot of the user. The raised left foot can also move during use of the back machine. A left leg restraint is attached to the left foot support to prevent such leg movement when the left foot is elevated. The left leg restraint and the left foot support are also substantially perpendicular.

In this manner, the back machine of the present invention can be utilized by individuals particularly those with chronic back pain to stretch the lower back muscles, and realign the lower spine from the middle to lower back and may reduce pain and discomfort emanating from lower back region. The back machine of the present invention can also provide increased joint mobility as well as strengthening of the lower spine.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 1:
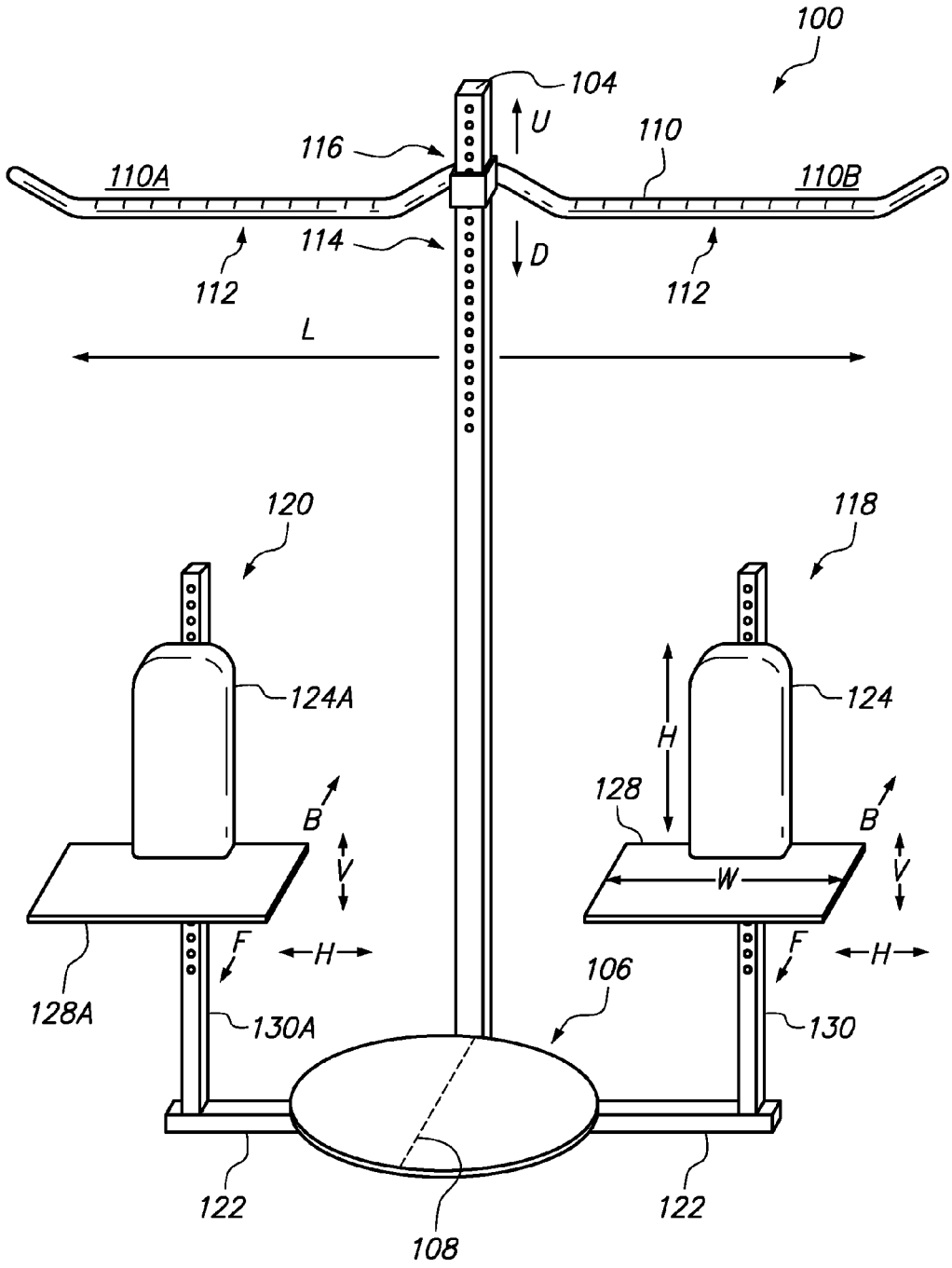
FIG. 1 illustrates a back machine according to an exemplary embodiment of the present invention.

FIG. 1 illustrates back machine 100 according to an exemplary embodiment of the present invention.

In FIG. 1, user 202 (FIG. 2) can utilize back machine 100 for aligning the lower back as well as stretching and exercising the lower back to increase mobility and strengthen the back. Back machine 100 comprises frame 104 fixedly coupled to base 106. As shown, base 106 is oval-shaped to form a sufficient support base for the entire back machine 100. One of ordinary skill in the art will understand that other shapes and sizes commensurate with the spirit and scope of the present invention can be utilized.

As shown, base 106 includes a demarcation line 108 against which user 202's heel can be placed. Base 106 might be a faceplate, which can be of sufficient thickness to provide the necessary support. Base 106 can be made of metal such as steel or durable polyurethane or other comparable materials. Base 106 can rest on the ground and is configured to rest substantially on any level surface and to receive the feet when user 202 is standing upright on base 106. Although not shown, base 106 can be adjustable along a direction away from or toward user 202.

As shown, frame 104 is rigid and extends in a vertical direction from the rear portion of base 106 to a height that is generally above that of upright user 202 standing on base 106. In an exemplary embodiment, the height of frame 104 is between 4 to 8 feet. Frame 104 is either fixedly attached to base 106 by welding or other comparable processes or can be detachably coupled via bolts and nuts or other comparable means. Frame 104 can be made of wrought iron, solid or tubular steel or other comparable material that can provide rigid and sufficient support when back machine 100 is in use.

Back machine 100 also includes cross handle bar 110, which is transversely attached in a horizontal direction across frame 104. In this manner, cross handle bar 110 can support the raised arms of user 202. Cross handle bar 110 and frame 104 are also slide-ably coupled such that cross handle bar 110 is adjustable in a vertical direction U or D as shown.

Cross handle bar 110 has calibrations 112 that can assist user 202 in determining where to place the hands. As noted, cross handle bar 110 can be raised in an upward direction U as well as lowered in a downward direction D as necessary to accommodate user 202's height. Cross handle bar 110 can be made of steel, wrought iron or other comparable materials. In order to provide guidance for the upward and downward movement of cross handle 110, calibrations 114 are provided on frame 104 as shown. Note that said calibrations can be in appropriate dimensions such as in inches, for example.

Indentation 116 on cross handle bar 110 projects cross handle bar 110 in a slightly forward direction toward user 202. However, cross handle bar 110 need not have such indentation and might simply be a straight handle bar or other suitable shape consistent with the spirit and scope of the present invention.

Also, although not shown, cross handle bar 110 might have grips to accommodate the user's palms, and said grips can be adjustable along the calibrations. Although a single cross handle bar has been shown, back machine 100 might comprise a series of sequential handle bars provided on the upper portion of frame 104, with said upper portion being perpendicular to the lower portion of frame 104 and said upper portion projecting toward the user. In this manner, user 202 can select a suitable handle bar that is convenient for the user.

Length (L) of the cross handle bar is such that it is longer than the length of the distance between user 202's first and second elbow when the user's hands are outstretched sideways perpendicular to the user's body. As discussed with reference to FIG. 2, below, this length allows user 202 to generate the requisite strength necessary for the torso twist for proper lower back alignment.

Back machine 100 also comprises left-foot elevator 118 and a right-foot elevator 120 that are generally coupled to base 106 via bar connectors 122. As implied by their names, left and right-foot elevators 118 and 120 assist user 202 to keep a respective foot elevated while the other foot remains on the floor. As such, the entirety of left-foot elevator 118 and right-foot elevator 120 are moveable and adjustable in a horizontal direction H, vertical direction V and in a forward F or backward B direction. As shown, each of right- and left-foot elevators is generally seat-shaped.

Left-foot elevator 118 comprises left-leg restraint 124 and left-foot support 128. Left-leg restraint 124 is located rearwardly of left-foot support 128. Left-leg restraint 124 has a plane that is substantially perpendicular to that of left-foot support 128. In this manner, left-leg restraint 124 prevents or restricts movement of user 202's left leg when user 202's right foot is positioned on base 106.

In FIG. 1, left-leg restraint 124 and left-foot support 128 are fixedly coupled to each other. Each leg restraint has a height H that is higher than the length from knee to ankle of user 202's lower extremity. Left-leg restraint 124 can be a plastic, steel, etc. frame, which is upholstered with leather, which interior consist of foam or like materials.

Left-foot support 128 can support user 202's raised left foot while the user's right foot remains on base 106. The width W of left-foot support 128 is wider than the length of the average user's foot. Left-foot support 128 is rigidly supported by support frame 130, which itself is coupled to connector 122. Although not shown, left-foot support 128 can also have footprint indentations for receiving the user's foot. Although left-leg restraint 124 has been shown as a padded leg-rest upon which a user's leg can rest, left-leg restraint 124 can be a strap or other comparable mechanism that can restrain a user's lower extremity.

In FIG. 1, referring now to right-foot elevator 120, the description of left-foot elevator 118 is also applicable to the corresponding features of right-foot elevator 120 as it relates to the right leg. For example, left-leg restraint 124 corresponds to right-leg restraint 124A, which restrains the right leg, left-foot support 128 corresponds to right-foot support 128A, which supports the right leg.

The operation of back machine 100 will now be described with reference to FIGS. 2 and 3 below.

Figure 2:
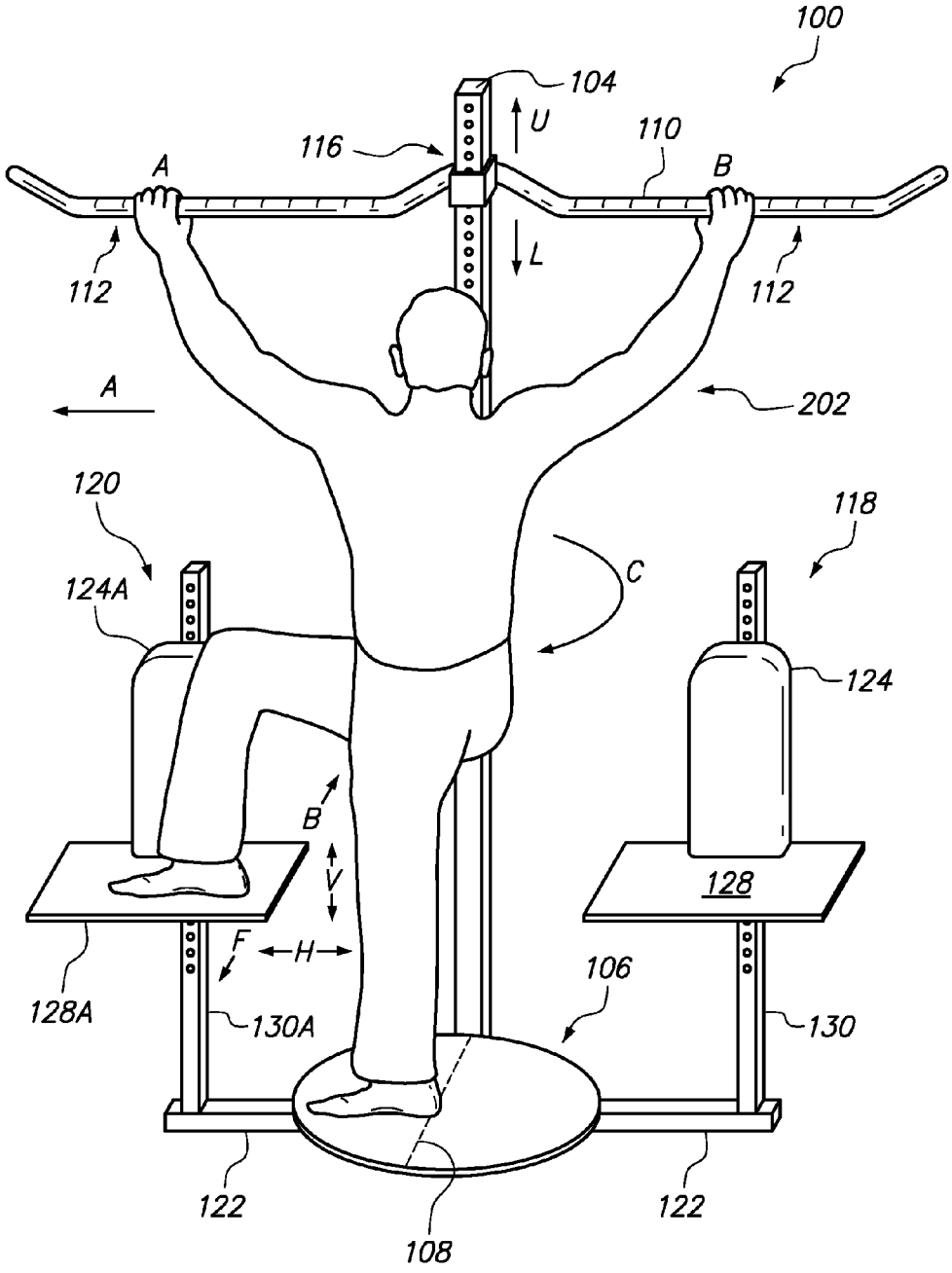
FIG. 2 illustrates use of the back machine of FIG. 1 according to an exemplary embodiment of the present invention.

FIG. 2 illustrates use of back machine 100 according to an exemplary embodiment of the present invention.

In FIG. 2, user 202 can strengthen, align and increase mobility of the left side of the lower spinal region. This left-side alignment is then followed by right-side alignment as discussed with reference to FIG. 3. The back alignment process is initiated when user 202 stands on base 106. Specifically, user 202 places both feet together, ankle to ankle and aligning the back heels of both feet against demarcation line 108 of base 106. At this point, user 202 is facing the left side designated by A and is sideways with respect to cross handle bar 110.

Next, user 202 raises the right leg onto right-foot support 128A while the left foot remains on base 106. Here, the right leg is resting against right-leg restraint 124A. The height of right-foot elevator 120 is then adjusted either upwards or downwards in a vertical direction until a suitable height is reached. The upwards or downwards movement also assists in targeting the preferred area of the spine. Right-foot elevator 120 is also adjusted in a horizontal direction either toward or away from user 202 until a suitable position is attained.

Similarly, right-foot elevator 120 can also be adjusted in a forward F or backward B direction so that user 202's right leg can firmly rest against right-leg restraint 124A. Conveniently, right-foot elevator 120 is adjusted to sufficiently elevate user 202's right foot until user 202 feels a stretch in the lower back. Next, user 202 turns clockwise and faces cross handle bar 110, after which said cross handle bar is firmly grasped with both hands.

Specifically, user 202 places the left hand at position A and the right hand at position B on cross handle bar 110. As previously noted, user 202's hands are sufficiently placed apart to be wider than the distance between user 202's left elbow and right elbow. Cross handle bar 110 can also be adjusted upward in the direction U or lower in the direction L to accommodate user 202's height.

After user 202 is comfortably positioned, that is, the right foot has been properly elevated while the right leg is firmly rested against right-leg restraint 124A and user 202's hands are comfortably gripping cross handle bar 110, user 202 then begins to twist the user's upper body and torso in a clockwise direction C. As the upper body and torso are twisted, user 202's right leg is restrained by right-leg restraint 124A and consequently a stretch and alignment is provided in user 202's lower spinal region particularly the lower left side region. Once this lower left side region is aligned, user 202 proceeds to align the lower right side as further discussed with reference to FIG. 3.

Figure 3:
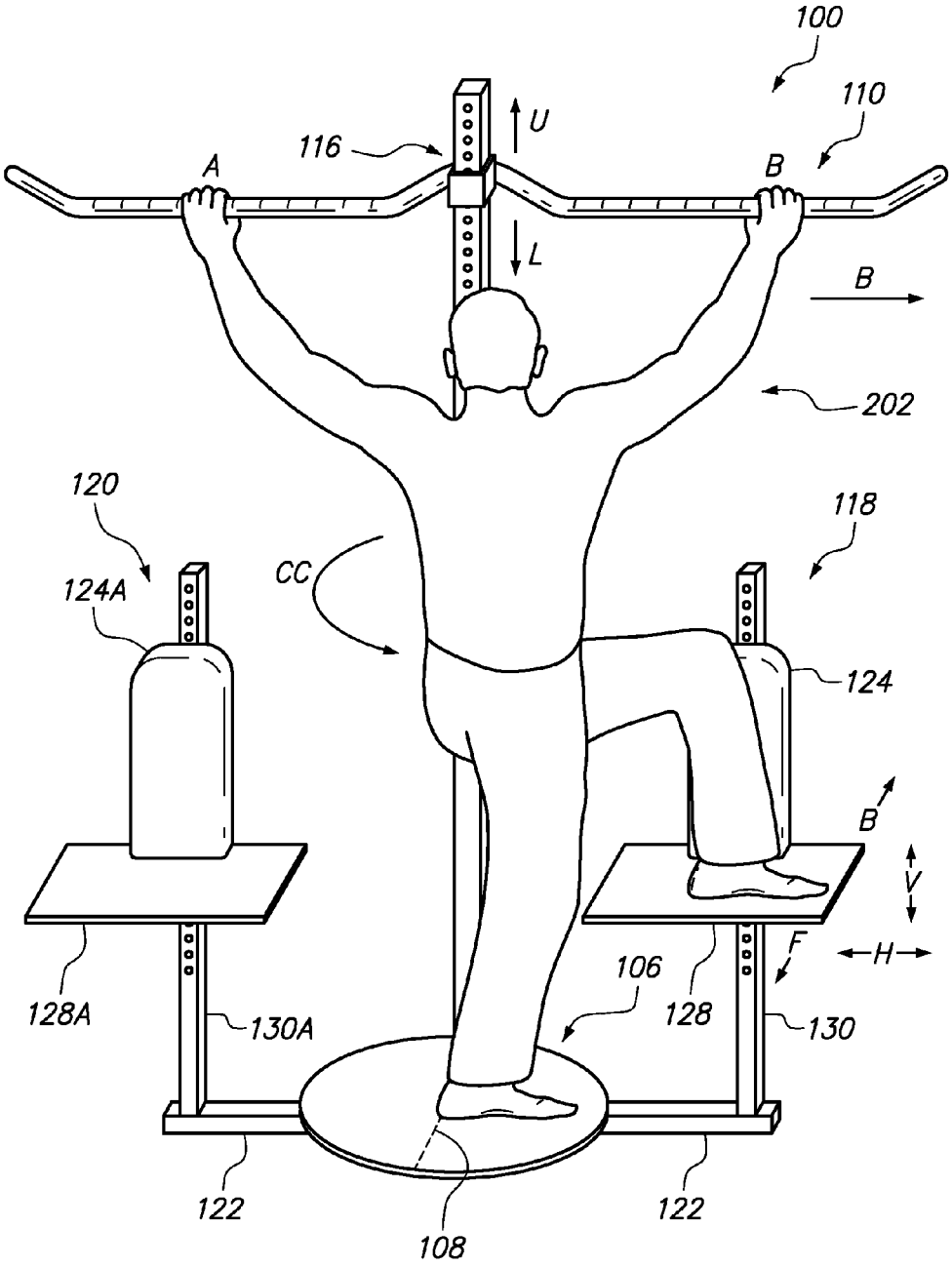
FIG. 3 illustrates use of the back machine of FIG. 1 according to an exemplary embodiment of the present invention.

FIG. 3 illustrates use of back machine 100 according to an exemplary embodiment of the present invention.

In FIG. 3, user 202 can perform alignment, and strengthen and increase mobility of the lower right side of the back region. User 202 begins by standing on base 106. User 202 aligns both feet with the ankle of each foot touching each other and user 202 facing the right direction B. User 202 faces the right direction such that the user is sideways to cross handle bar 110.

Next, user 202 raises a left foot onto left-foot support 128 while the side of the left leg rests against left-leg restraint 124. The height of left-foot elevator 118 is adjusted to a comfortable height. The direction of left-foot elevator 118 can be adjusted in a horizontal or vertical direction to accommodate the user's height as appropriate.

Next, user 202 places both hands on cross handle bar 110 at positions A and B. The hands are sufficiently spaced apart to be longer than the distance between the user's elbows. The height of cross handle bar 110 is adjustable in an upward direction U or a lower direction L as needed. Once user 202 has made all the necessary adjustments as to be comfortable, user 202 begins to twist the upper body and torso in a counter-clockwise direction CC.

Since the left-leg restraint 124 restrains the user's left leg as the user twists the torso in an anti-clockwise direction, the muscles in user 202's lower spine are stretched and begin to align the user's spine in order to create muscle and joint mobility and strengthen the lower back.

In this manner, back machine 100 can be employed by individuals particularly those with chronic back pain to stretch the lower back muscles and realign the lower spine and may reduce pain and discomfort emanating from the lower back region. Back machine 100 of the present invention can also provide increased joint mobility as well as strengthening of the lower spine.

While the above is a complete description of exemplary specific embodiments of the invention, additional embodiments are also possible. Thus, the above description should not be taken as limiting the scope of the invention, which is defined by the appended claims along with their full scope of equivalents.

I claim:

1. A back machine comprising:

a base, wherein said base is configured to rest substantially on a level surface;

an elongated bar extending in a vertical direction from a rearward portion of said base to a height that is generally above that of an upright user standing on said base;

a handle bar transversely and generally disposed across an upper end of said elongated bar, said handle bar supporting each raised arm of said upright user;

a right foot support elevated above said base, said right foot support supporting a right foot of said user when said right foot is raised onto said right foot support while a left foot of said user remains on said base;

a right leg restraint located rearwardly to said right foot support, said right leg restraint having a plane that is substantially perpendicular to a plane of said right foot support, said right leg restraint preventing movement of a right leg of said user when said right foot is positioned on said right foot support;

a left foot support elevated above said base, said left foot support supporting a left foot of said user when said left foot is raised onto said left foot support while a right foot of said user remains on said base; and a left leg restraint located rearwardly to said left foot support, said left leg restraint having a plane that is substantially perpendicular to a plane of said left foot support, said left leg restraint preventing movement of a left leg of said user when said left foot is positioned on said left foot support.

2. The back machine of claim 1 wherein said handle bar is height adjustable.

3. The back machine of claim 1 wherein said handle bar further comprises a left grip and a right grip.

4. The back machine of claim 1 wherein each of said right foot support and said left foot support is height adjustable.

5. A method for using the back machine of claim 1 to align a user's back, the method comprising:

using the back machine to receive a user standing upright in front of said machine, said back machine resting on a substantially level surface;

using said back machine to support each arm of said user, each arm being raised to a height that is generally above that of the upright user;

using said back machine to support a right foot of said user when said right foot is raised while a left foot of said user remains on the level surface;

using said back machine to restrain movement of a right leg of said user when said right foot is being supported and said user's torso is twisted in a clockwise direction;

after said step of using said back machine to support a right foot, using said back machine to support a left foot of said user when said left foot is raised while a right foot of said user remains on said level surface; and using said back machine to restrain movement of a left leg of said user while said left foot is raised and said user's torso is twisted in a counter clockwise direction in order to align said user's lower back.

6. A back machine comprising:

a base portion;

a frame portion, wherein said frame portion comprises a lower end attached to said base portion, wherein said frame portion extends in a vertical direction from said base portion to a height that is substantially above that of an average user standing upright on said base portion;

a handle bar portion, wherein said handle bar portion is adjustably attached to said frame portion at an upper end of said frame portion;

a right foot support elevated above said base, said right foot support being adapted to support a right foot of said user;

a right leg restraint proximate to said right foot support, said right leg restraint restraining movement of said user's right leg when said right foot is elevated and said user's upper body is twisted in a clockwise direction;

a left foot support elevated above said base, said left foot support being adapted to support said left foot of said user; and a left leg restraint proximate to said left foot support, said left leg restraint restraining movement of a user's left leg when said left foot is elevated and said user's upper body is twisted in a counter clockwise direction.

7. The back machine of claim 6 wherein said handle bar portion is height adjustable.

8. The back machine of claim 6 wherein said handle bar portion further comprises a left grip and right grip.

9. The back machine of claim 6 wherein each of said right foot support and said left foot support is height adjustable.

10. The back machine of claim 6 wherein said left leg restraint restraints a user's left leg during twisting of a user's torso.

11. The back machine of claim 6 wherein said right leg restraint and said left leg restraint are positioned in front of said user.

* * * * *